US011326364B2

(12) United States Patent
Zhao et al.

(10) Patent No.: US 11,326,364 B2
(45) Date of Patent: May 10, 2022

(54) FUNCTION-RECOVERING ENERGY-DISSIPATING REINFORCED CONCRETE SHEAR WALL AND CONSTRUCTION METHOD THEREOF

(71) Applicant: ZHENGZHOU UNIVERSITY, Zhengzhou (CN)

(72) Inventors: Jun Zhao, Zhengzhou (CN); Xiangcheng Zhang, Zhengzhou (CN); Xiaohui Ruan, Zhengzhou (CN); Yuping Sun, Zhengzhou (CN); Jiajia Zhou, Zhengzhou (CN); Liusheng Chu, Zhengzhou (CN); Xiaopeng Li, Zhengzhou (CN)

(73) Assignee: ZHENGZHOU UNIVERSITY

( * ) Notice: Subject to any disclaimer, the term of this patent is extended or adjusted under 35 U.S.C. 154(b) by 523 days.

(21) Appl. No.: 16/342,366

(22) PCT Filed: Aug. 2, 2018

(86) PCT No.: PCT/CN2018/098321
§ 371 (c)(1),
(2) Date: Apr. 16, 2019

(87) PCT Pub. No.: WO2019/205336
PCT Pub. Date: Oct. 31, 2019

(65) Prior Publication Data

US 2021/0372156 A1 Dec. 2, 2021

(30) Foreign Application Priority Data

Apr. 28, 2018 (CN) ..... 201810397680.3

(51) Int. Cl.
*E04H 9/02* (2006.01)
*E04B 1/98* (2006.01)
*E04B 2/00* (2006.01)

(52) U.S. Cl.
CPC ..... *E04H 9/0235* (2020.05); *E04B 1/98* (2013.01); *E04B 2/00* (2013.01); *E04H 9/02* (2013.01);
(Continued)

(58) Field of Classification Search
CPC ..... E04B 1/98; E04B 2/00; E04H 9/02; E04H 9/021; E04H 9/0215; E04H 9/0235; E04H 9/027
See application file for complete search history.

(56) References Cited

U.S. PATENT DOCUMENTS 5,630,298 A * 5/1997 Tsai ..... E04H 9/021 52/167.1
6,651,395 B2 * 11/2003 Capra ..... E04H 9/021 52/167.8
(Continued)

FOREIGN PATENT DOCUMENTS

CN 107345426 A * 11/2017
CN 107386481 A * 11/2017
(Continued)

*Primary Examiner* — Jessie T Fonseca

(57) ABSTRACT

A function-recovering energy-dissipating reinforced concrete shear wall comprising a reinforced concrete shear wall body, common steel bars distributed in vertical direction within the reinforced concrete shear wall body, common steel bars distributed in horizontal direction within the reinforced concrete shear wall body, high-strength reinforcing materials arranged on left and right sides of the shear wall, and four dampers arranged in an X-shaped cross mode between a front reinforcement fabric and a rear reinforcement fabric that are formed by common steel bars distributed in vertical direction and common steel bars distributed in horizontal direction; a cylindrical piston rod having a hinge hole is arranged at the end portion of each damper.

7 Claims, 3 Drawing Sheets

(52) U.S. Cl.
CPC ..... *E04H 9/021* (2013.01); *E04H 9/027* (2013.01); *E04H 9/0215* (2020.05)

(56) References Cited

U.S. PATENT DOCUMENTS

| | | | | |
|---|---|---|---|---|
| 9,567,763 | B2 * | 2/2017 | Miyazawa | E04H 9/024 |
| 9,885,175 | B1 * | 2/2018 | Izumi | E04H 9/021 |
| 2010/0313496 | A1 * | 12/2010 | Rahimian | E04H 9/0237 52/167.3 |
| 2012/0038091 | A1 * | 2/2012 | Tagawa | E04H 9/021 267/136 |
| 2012/0260585 | A1 * | 10/2012 | Mualla | E04B 1/98 52/167.1 |
| 2015/0184413 | A1 * | 7/2015 | Pryor | E04C 3/04 52/167.3 |
| 2017/0058514 | A1 * | 3/2017 | Wu | E04H 9/021 |
| 2017/0145686 | A1 * | 5/2017 | Lee | E04B 1/98 |
| 2018/0002942 | A1 * | 1/2018 | Vanker | E04B 1/98 |
| 2018/0334826 | A1 * | 11/2018 | Towfighi | F16F 15/0275 |

FOREIGN PATENT DOCUMENTS

| | | | | |
|---|---|---|---|---|
| CN | 107460969 | A | * | 12/2017 |
| CN | 107675931 | A | * | 2/2018 |
| CN | 111535498 | B | * | 10/2020 |
| CN | 111962707 | A | * | 11/2020 |
| CN | 112031193 | A | * | 12/2020 |
| CN | 112609860 | A | * | 4/2021 |
| CN | 112814190 | A | * | 5/2021 |

* cited by examiner

FUNCTION-RECOVERING ENERGY-DISSIPATING REINFORCED CONCRETE SHEAR WALL AND CONSTRUCTION METHOD THEREOF

TECHNICAL FIELD OF THE INVENTION

The present invention relates to the technical field of anti-seismic building structures, and more particularly, to a function-recovering energy-dissipating reinforced concrete shear wall and a construction method thereof.

BACKGROUND OF THE INVENTION

In modern concrete structural engineering, a reinforced concrete shear wall is a primary element of a seismic force resisting system that is designed to resist seismic loads. Its bearing capacity and seismic performance are crucial for ensuring the safety of high-rise buildings. Presently, the basic principle of designing the seismic structure of high-rise buildings in China is to keep buildings undamaged in small earthquakes, make buildings repairable after moderate earthquakes, and prevent buildings from collapsing in violent earthquakes. Under the strong earthquake action, the reinforced concrete shear wall functions to dissipate the seismic energy mainly through an elastic-plastic deformation. As a consequence, different degrees of damage and large residual deformation can occur to the concrete shear wall, resulting in its difficult recovery and loss of function. In such circumstances, the concrete shear wall needs to be demolished and rebuilt. In the prior art, in order to reduce the residual deformation and achieve a quick function recovery, seismic structures such as a self-recovering shear wall and a swing shear wall have been proposed and designed both in domestic and abroad in recent years. By arranging high-strength steel bars or steel strands in the shear walls, the strength, the safety margin and the deformability of the shear wall structures can be greatly improved. Thus, even under the action of strong earthquake, the elastic performance can be kept, the post-earthquake residual deformation can be reduced, and a quick function recovery can be achieved.

However, although high-strength steel bars or steel strands ensure the elastic performance of the shear walls, and allow them to quickly recover during strong earthquake, a severe structural deformation is unavoidable and the energy-dissipating capacity is seriously insufficient.

In conclusion, the shortcomings of traditional shear walls are urgent problems that need to be solved for those skilled in this field.

SUMMARY OF THE INVENTION

The purpose of the present invention is to solve the shortcomings in the prior art by providing a function-recovering energy-dissipating reinforced concrete shear wall. For the dampers arranged in the wall body possess a high energy-dissipating capacity, the seismic performance of the structure can be greatly improved during the earthquake, and a quick post-earthquake function-recovery can be achieved. The present invention also provides a simple and reliable construction method of the function-recovering energy-dissipating reinforced concrete shear wall.

To achieve the above purpose, the present invention adopts the following technical solution:

A function-recovering energy-dissipating reinforced concrete shear wall of the present invention comprising a reinforced concrete shear wall body, common steel bars distributed in vertical direction within the reinforced concrete shear wall body, common steel bars distributed in horizontal direction within the reinforced concrete shear wall body, high-strength reinforcing materials arranged on the left and right sides of the reinforced concrete shear wall body, and four dampers distributed in an X-shape between a front reinforcement fabric and a rear reinforcement fabric that are formed by common steel bars distributed in vertical direction and common steel bars distributed in horizontal direction; the piston rod at the lower end of the damper located at the upper left, the piston rod at the lower end of the damper located at the upper right, the piston rod at the upper end of the damper located at the lower left and the piston rod at the upper end of the damper located at the lower right are cylindrical piston rods having a hinge hole at the end portion; a rhombic structure is formed by the end portion of the piston rod at the lower end of the damper located at the upper left, the end portion of the piston rod at the lower end of the damper located at the upper right, the end portion of the piston rod at the upper end of the damper located at the lower left and the end portion of the piston rod at the upper end of the damper located at the lower right; steel plate connecting rods are arranged on the four edges of the rhombic structure, and every two steel plate connecting rods adjacent to each other are connected with the end portion of the piston rod through a movable hinge; the steel plate connecting rod is arranged within a rhombic connecting rod protective shell having grooves, and circular guide holes are formed in the four corners of the rhombic connecting rod protective shell; an annular connecting sleeve is arranged above the circular guide hole; the end portion of the annular connecting sleeve is provided with a fixing edge, and the annular connecting sleeve is fixed to the connecting flange of the damper through the fixing edge; steel strands are arranged at the end portion of the piston rod at the upper end of the damper located at the upper left, the end portion of the piston rod at the upper end of the damper located at the upper right, the end portion of the piston rod at the lower end of the damper located at the lower left, and the end portion of the piston rod at the lower end of the damper located at the lower right; the steel strands are anchored on the reinforced concrete shear wall through anchor plates; metal corrugated tubes are arranged on the periphery of the steel strand connected with the piston rod at the upper end of the damper located at the upper left, the periphery of the steel strand connected with the piston rod at the upper end of the damper located at the upper right, the periphery of the steel strand connected with the piston rod at the lower end of the damper located at the lower left, and the periphery of the steel strand connected with the piston rod at the lower end of the damper located at the lower right; cylindrical pistons are arranged between the piston rod at the upper end of the damper located at the upper left and the piston rod at the lower end of the damper located at the upper left, between the piston rod at the upper end of the damper located at the upper right and the piston rod at the lower end of the damper located at the lower right, between the piston rod at the upper end of the damper located at the lower left and the piston rod at the lower end of the damper located at the lower left, and between the piston rod at the upper end of the damper located at the lower right and the piston rod at the lower end of the damper located at the lower right; a cylinder barrel is arranged outside the cylindrical piston rod, and an annular space is left between the cylindrical piston and the cylinder barrel; the lower end of the cylinder barrel is fixed to the connecting flange, and a circular cover plate is arranged at the upper end of the cylinder barrel; a sealing cavity is formed among the inner surface of the cylinder barrel, the outer surfaces of the piston rod and the cylindrical piston, the connecting flange and the circular cover plate; the sealing cavity is filled with an energy-dissipating material.

In another aspect of the present invention, the damper can be a viscous damper, a visco-elastic damper, a magneto-rheological damper or an electro-rheological damper.

In another aspect of the present invention, the rhombic structure composed of steel plate connecting rods can freely stretch and contract within the protective shell.

In another aspect of the present invention, the anchor point of the anchor plate at the lower left is defined as A, the anchor point of the anchor plate at the upper left is defined as B, the anchor point of the anchor plate at the upper right is defined as C, and the anchor point of the anchor plate at the lower right is defined as D.

In another aspect of the present invention, the steel strands need to be equally prestressed.

In another aspect of the present invention, the damper can be a velocity-correlated damper without an initial stiffness, such as a viscous damper or a viscoelastic damper, or can be a magneto-rheological damper or an electro-rheological damper.

In another aspect of the present invention, circular guide holes arranged in a cross shape and square-shaped grooves are formed in the rhombic connecting rod protective shell, and the rhombic connecting rod mechanism can freely stretch and contract within the protective shell.

In another aspect of the present invention, a hinge hole is formed in the end portion of the cylindrical piston rod.

A construction method of the function-recovering energy-dissipating reinforced concrete shear wall of the present invention, comprising the steps of:

Step 1: preparing a front reinforcement fabric and a rear reinforcement fabric that are formed by high-strength reinforcing materials distributed in vertical direction and common steel bars, wherein the common steel bars distributed in vertical direction and the common steel bars distributed in horizontal direction are connected in a colligation mode;

Step 2: assembling the dampers, wherein the piston and the piston rod of each damper are connected first; subsequently, installing the connecting flange at the lower end of the damper cylinder barrel, inserting the pre-connected piston and piston rod into the damper cylinder barrel from the above, and ensuring that the cylindrical piston rod having a hinge hole can pass through the center hole of the connecting flange; finally, installing a circular cover plate at the upper end of the damper cylinder barrel;

Step 3: connecting the dampers and the rhombic connecting rod protective shell, placing the four dampers at the four corners of the rhombic connecting rod protective shell, and putting the cylindrical piston rod having a hinge hole into a circular guide hole of the rhombic connecting rod protective shell; subsequently, fixing the connecting flanges of the four dampers and the connecting sleeves at the four corners of the rhombic connecting rod protective shell, and installing steel plate connecting rods in the rhombic connecting rod protective shell; finally, installing the cover plate of the rhombic connecting rod protective shell;

Step 4: installing the dampers and the rhombic connecting rod protective shell, placing the metal corrugated tubes to corresponding installation positions, fixing them on the reinforcement fabrics, and inserting steel strand into each metal corrugated tube; subsequently, placing the pre-connected dampers to corresponding installation positions between the front and rear reinforcement fabrics from the top of the reinforcement fabrics, and connecting the steel strands with the piston rods of the dampers; finally, installing a framework and a framework support outside the reinforcement fabrics, and fixing the dampers and the rhombic connecting rod protective shell to the framework support;

Step 5: pouring concrete; subsequently, simultaneously stretch-drawing and anchoring the four steel strands at the four corners of the wall body after the poured concrete reaches the design strength.

Compared with the prior art, the present invention has the following advantages:

First, through the high-strength reinforcing materials arranged on the left and right sides of the wall body, the elastic performance of the structure under the action of strong earthquake can be ensured, the post-earthquake residual deformation of the shear wall can be reduced, and a quick function-recovery of the reinforced concrete shear wall can be achieved. Thus, the buildings can be safely used after the earthquake.

Second, through the dampers arranged in the wall body, the energy-dissipating capacity of the shear wall can be enhanced, and the dynamic response of the structure can be weakened. The dampers can be either velocity-correlated dampers or magneto-rheological/electro-rheological dampers, which do not affect the post-earthquake function-recovery of the shear wall.

Third, the present invention provides a simple and reliable construction method of the function-recovering energy-dissipating reinforced concrete shear wall.

BRIEF DESCRIPTION OF THE DRAWINGS

To clearly expound the technical solution of the present invention, the drawings and embodiments are hereinafter combined to illustrate the present invention. Obviously, the drawings are merely some embodiments of the present invention and those skilled in the art can associate themselves with other drawings without paying creative labor.

DETAILED DESCRIPTION OF THE INVENTION

Drawings and detailed embodiments are combined hereinafter to elaborate the technical principles of the present invention.

Figure 1:
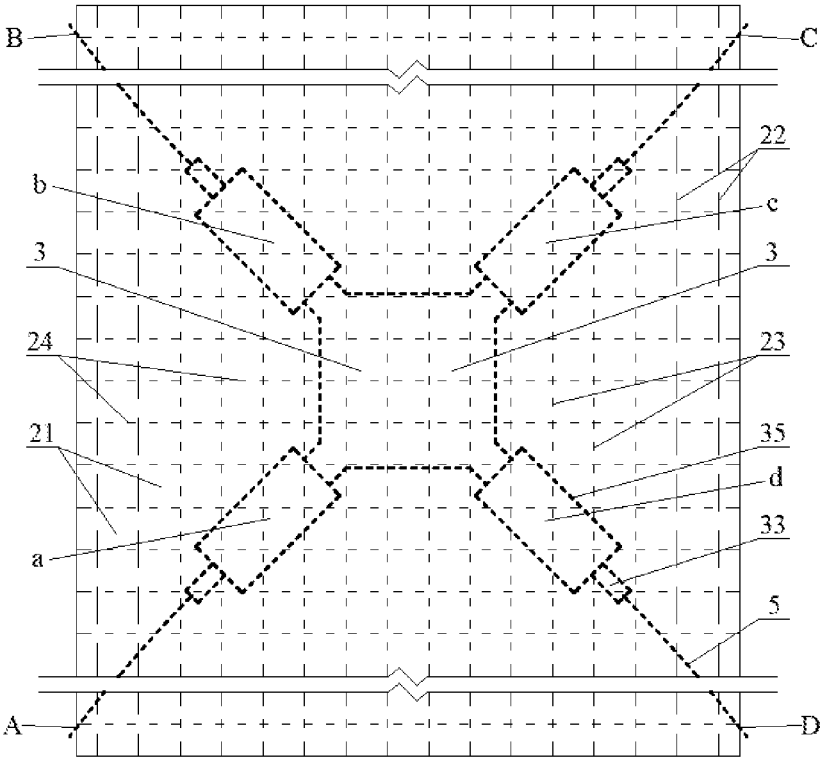
FIG. 1 is a schematic diagram illustrating the structural assembly of the flexible energy-dissipating damping devices used in building engineering of the present invention.
Figure 2:
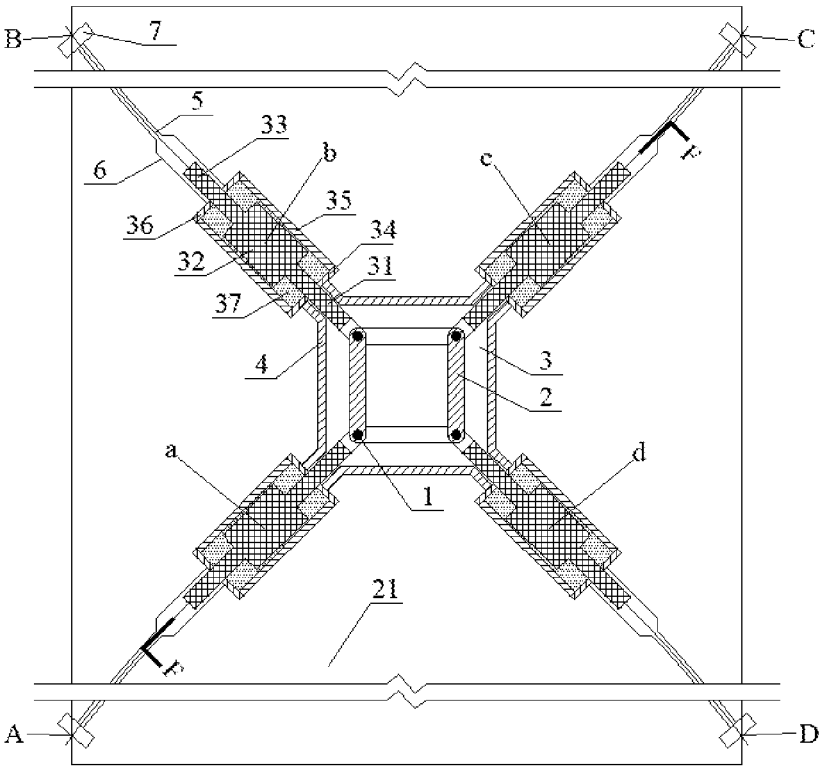
FIG. 2 is a vertical sectional view of FIG. 1.
Figure 3:
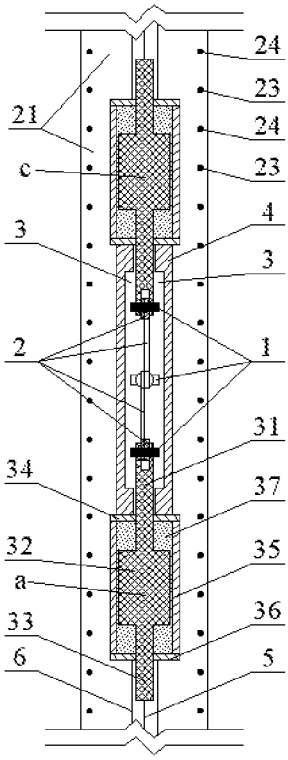
FIG. 3 is a sectional view taken along line F-F in FIG. 2.

As shown in FIGS. 1-3, the function-recovering energy-dissipating reinforced concrete shear wall of the present invention comprises a reinforced concrete shear wall body 21, common steel bars 23 distributed in vertical direction within the reinforced concrete shear wall body 21, common steel bars 24 distributed in horizontal direction within the reinforced concrete shear wall body 21, high-strength reinforcing materials 22 arranged on left and right sides of the shear wall, and four dampers arranged in an X-shaped cross mode between a front reinforcement fabric and a rear reinforcement fabric that are formed by common steel bars 23 distributed in vertical direction and common steel bars 24 distributed in horizontal direction. A cylindrical piston rod 31 having a hinge hole is arranged at the end portion of each damper. The cylindrical piston rods 31 are connected through movable hinges 1 and rhombic steel plate connecting rods 2. Each rhombic steel plate connecting rod 2 is arranged within a groove 3 formed in a rhombic connecting rod protective shell 4. A connecting flange 34 of the damper is fixedly connected with the rhombic connecting rod protective shell 4 through circular guide holes formed in a cross shape in the rhombic connecting rod protective shell 4. The rhombic connecting rod protective shell 4, damper cylinder barrels 35 and the reinforced concrete shear wall body 21 are poured together. One end of a steel strand 5 is connected with a cylindrical piston lever 33 of the damper, and a metal corrugated tube 6 is arranged outside the steel strand 5 and the cylindrical piston lever 33. The other end of the steel strand 5 is anchored at the point B of the reinforced concrete shear wall through an anchoring device 7, and points A, C and D are also anchoring points of the steel strands.

A construction method of the function-recovering energy-dissipating reinforced concrete shear wall of the present invention, comprising the steps of:

Step 1: preparing a front reinforcement fabric and a rear reinforcement fabric that are formed by high-strength reinforcing materials distributed in vertical direction and common steel bars, wherein the common steel bars distributed in vertical direction and the common steel bars distributed in horizontal direction are connected in a colligation mode;

Step 2: assembling the dampers, wherein the piston and the piston rod of each damper are connected first; subsequently, installing the connecting flange at the lower end of the damper cylinder barrel, inserting the pre-connected piston and piston rod into the damper cylinder barrel from the above, and ensuring that the cylindrical piston rod having a hinge hole can pass through the center hole of the connecting flange; finally, installing a circular cover plate at the upper end of the damper cylinder barrel;

Step 3: connecting the dampers and the rhombic connecting rod protective shell, placing the four dampers at the four corners of the rhombic connecting rod protective shell, and putting the cylindrical piston rod having a hinge hole into a circular guide hole of the rhombic connecting rod protective shell; subsequently, fixing the connecting flanges of the four dampers and the connecting sleeves at the four corners of the rhombic connecting rod protective shell, and installing steel plate connecting rods in the rhombic connecting rod protective shell; finally, installing the cover plate of the rhombic connecting rod protective shell;

Step 4: installing the dampers and the rhombic connecting rod protective shell, placing the metal corrugated tubes to corresponding installation positions, fixing them on the reinforcement fabrics, and inserting steel strand into each metal corrugated tube; subsequently, placing the pre-connected dampers to corresponding installation positions between the front and rear reinforcement fabrics from the top of the reinforcement fabrics, and connecting the steel strands with the piston rods of the dampers; finally, installing a framework and a framework support outside the reinforcement fabrics, and fixing the dampers and the rhombic connecting rod protective shell to the framework support;

Step 5: pouring concrete; subsequently, simultaneously stretch-drawing and anchoring the four steel strands at the four corners of the wall body after the poured concrete reaches the design strength.

The operating principle of the present invention is the following:

Under the action of seismic loads, an interlayer relative displacement of the shear wall structure can be caused. The points A and B at the left and right ends of the upper part of the shear wall body are displaced relative to the points C and D at the lower part of the shear wall body. When the distance between the points A and C are lengthened (at the moment, the distance between the points B and D is shortened), for a prestressing force is imposed on steel strands 5, and the points A and C are connected to the points B and D through a flexible system composed of steel strands 5, damper pistons 32, cylindrical piston rods 31 having a hinge hole at the end portion, movable hinges 1 and steel plate connecting rods, the damper pistons 32 of the dampers a and c are far from each other under the action of the tensile force of the steel strands, and are displaced relative to the cylinder barrels 35 of the dampers a and c. Simultaneously, the lower left and upper right ends of the rhombic steel plate connecting rod 2 are lengthened, and the upper left and lower right ends of the rhombic steel plate connecting rod 2 are shortened. The damper pistons 32 of the dampers b and d approach each other under the action of the tensile force of the rhombic steel plate connecting rod 2, and are displaced relative to the cylinder barrels of the dampers b and d. When there's relative displacement between the pistons and cylinder barrels of the dampers, the shear wall body functions to resist the seismic loads. Thus, the seismic energy introduced to the building structure can be effectively dissipated, the dynamic response of the structure under the action of seismic loads can be significantly weakened, and the seismic performance of the building structure can be greatly enhanced. It's the same when the distance between the points B and D are lengthened (at the moment, the distance between the points A and C are shortened).

Further, for the high-strength reinforcing materials 22 arranged at the left and right sides of the reinforced concrete shear wall body possess a high tensile strength and a low elastic modulus, the structure can be always kept in an elastic working state. Thus, once the earthquake is over, the high-strength reinforcing materials can quickly pull the reinforced concrete shear wall body back to its original position. At the moment, the residual deformation is small, enabling the structure to quickly recover its function.

The description of above embodiments allows those skilled in the art to realize or use the present invention. Without departing from the spirit and essence of the present invention, those skilled in the art can combine, change or modify correspondingly according to the present invention. Therefore, the protective range of the present invention should not be limited to the embodiments above but conform to the widest protective range which is consistent with the principles and innovative characteristics of the present invention. Although some special terms are used in the description of the present invention, the scope of the invention should not necessarily be limited by this description. The scope of the present invention is defined by the claims.

The invention claimed is:

1. A function-recovering energy-dissipating reinforced concrete shear wall, comprising:

a reinforced concrete shear wall body, common steel bars distributed in vertical direction within the reinforced concrete shear wall body, common steel bars distributed in horizontal direction within the reinforced concrete shear wall body, high-strength reinforcing materials arranged on left and right sides of the reinforced concrete shear wall body, and four dampers distributed in an X-shape between a front reinforcement fabric and a rear reinforcement fabric that are formed by the common steel bars distributed in vertical direction and the common steel bars distributed in horizontal direction, wherein a piston rod at a lower end of the damper located at upper left, a piston rod at a lower end of the damper located at upper right, a piston rod at an upper end of the damper located at lower left and a piston rod at an upper end of the damper located at lower right are each cylindrical having a hinge hole at an end portion, wherein a rhombic structure is formed by the end portion of the piston rod at the lower end of the damper located at the upper left, the end portion of the piston rod at the lower end of the damper located at the upper right, the end portion of the piston rod at the upper end of the damper located at the lower left, and the end portion of the piston rod at the upper end of the damper located at the lower right, wherein steel plate connecting rods are arranged on the four edges of the rhombic structure, and every two of the steel plates connecting rods adjacent to each other are connected with the end portion of one of the piston rods through a movable hinge, wherein each of the steel plate connecting rods is arranged within a rhombic connecting rod protective shell having grooves, and wherein circular guide holes are formed in four corners of the rhombic connecting rod protective shell, wherein an annular connecting sleeve is arranged above each of the circular guide holes, wherein an end portion of the annular connecting sleeve is provided with a fixing edge, and the annular connecting sleeve is fixed to a connecting flange of each damper through the fixing edge, wherein steel strands are arranged at an end portion of the piston rod at an upper end of the damper located at the upper left, an end portion of the piston rod at an upper end of the damper located at the upper right, an end portion of the piston rod at a lower end of the damper located at the lower left, and an end portion of the piston rod at a lower end of the damper located at the lower right, wherein each of the steel strands are anchored on the reinforced concrete shear wall through an anchor plate, wherein metal corrugated tubes are arranged on periphery of the steel strand connected with the piston rod at the upper end of the damper located at the upper left, periphery of the steel strand connected with the piston rod at the upper end of the damper located at the upper right, periphery of the steel strand connected with the piston rod at the lower end of the damper located at the lower left, and periphery of the steel strand connected with the piston rod at the lower end of the damper located at the lower right, wherein pistons are arranged between the piston rod at the upper end of the damper located at the upper left and the piston rod at the lower end of the damper located at the upper left, between the piston rod at the upper end of the damper located at the upper right and the piston rod at the lower end of the damper located at the lower right, between the piston rod at the upper end of the damper located at the lower left and the piston rod at the lower end of the damper located at the lower left, and between the piston rod at the upper end of the damper located at the lower right and the piston rod at the lower end of the damper located at the lower right, wherein a cylinder barrel is arranged outside each piston rod, and an annular space is left between the respective piston and the respective cylindrical barrel, wherein a end of the cylinder barrel is fixed to a connecting flange, and a circular cover plate is arranged at an opposite end of each cylinder barrel, wherein a sealing cavity is formed among the inner surface of each cylinder barrel, outer surfaces of each piston rod and each piston, each connecting flange and each circular cover plate, wherein the sealing cavity is filled with an energy-dissipating material.

2. The function-recovering energy-dissipating reinforced concrete shear wall of claim 1, wherein the reinforcing materials are steel strands or fiber reinforced composite bars.

3. The function-recovering energy-dissipating reinforced concrete shear wall of claim 1, wherein the rhombic structure composed of the steel plate connecting rods are capable of stretching and contracting within the protective shell.

4. The function-recovering energy-dissipating reinforced concrete shear wall of claim 1, wherein an anchor point of an anchor plate at the lower left is defined as A, an anchor point of an anchor plate at the upper left is defined as B, an anchor point of an anchor plate at the upper right is defined as C, and an anchor point of an anchor plate at the lower right is defined as D.

5. The function-recovering energy-dissipating reinforced concrete shear wall of claim 1, wherein the rhombic connecting rod protective shell, the cylinder barrels and the reinforced concrete shear wall body are poured together.

6. The function-recovering energy-dissipating reinforced concrete shear wall of claim 1, wherein the dampers are viscous dampers, viscoelastic dampers, magneto-rheological dampers or electro-rheological dampers.

7. A construction method of function-recovering energy-dissipating reinforced concrete shear wall, comprising the steps of:

Step 1: preparing a front reinforcement fabric and a rear reinforcement fabric that are formed by high-strength reinforcing materials, wherein common steel bars distributed in vertical direction and common steel bars distributed in horizontal direction are connected in a colligation mode;

Step 2: assembling dampers, wherein a piston and a piston rod of each damper are connected first; subsequently, installing a connecting flange at a lower end of a damper cylinder barrel, inserting the piston and piston rod into the damper cylinder barrel; installing a circular cover plate at an upper end of the damper cylinder barrel;

Step 3: connecting the dampers and a rhombic connecting rod protective shell, placing the four dampers at four corners of the rhombic connecting rod protective shell, and putting the piston rod of each damper having a hinge hole into a circular guide hole of the rhombic connecting rod protective shell; subsequently, fixing the connecting flanges of the four dampers and connecting sleeves at the four corners of the rhombic connecting rod protective shell, and installing steel plate connecting rods in the rhombic connecting rod protective shell; finally, installing a cover plate of the rhombic connecting rod protective shell;

Step 4: installing the dampers and the rhombic connecting rod protective shell, placing metal corrugated tubes to corresponding installation positions, fixing them on the reinforcement fabrics, and inserting steel strand into each metal corrugated tube; subsequently, placing the dampers to corresponding installation positions between front and rear reinforcement fabrics from top of the reinforcement fabrics, and connecting the steel strands with the piston rods; finally, installing a framework and a framework support outside the reinforcement fabrics, and fixing the dampers and the rhombic connecting rod protective shell to the framework support;

Step 5: pouring concrete; subsequently, simultaneously stretch-drawing and anchoring the steel strands at four corners of a wall body after the poured concrete reaches a design strength.

* * * * *